US008430035B2

(12) United States Patent
Ducastel, Jr.

(10) Patent No.: US 8,430,035 B2
(45) Date of Patent: Apr. 30, 2013

(54) CARTRIDGE AND CHAMBER FOR SIMULATED FIREARM

(76) Inventor: Charles J. Ducastel, Jr., Columbus, IN (US)

( * ) Notice: Subject to any disclaimer, the term of this patent is extended or adjusted under 35 U.S.C. 154(b) by 174 days.

(21) Appl. No.: 12/924,425

(22) Filed: Sep. 27, 2010

(65) Prior Publication Data

US 2011/0016763 A1 Jan. 27, 2011

Related U.S. Application Data

(63) Continuation-in-part of application No. 11/114,494, filed on Apr. 26, 2005, now abandoned.

(60) Provisional application No. 60/565,440, filed on Apr. 27, 2004.

(51) Int. Cl.
*F42B 8/02* (2006.01)
*F42B 8/04* (2006.01)

(52) U.S. Cl.
USPC ..... 102/444

(58) Field of Classification Search ..... 102/430, 102/444, 465, 466, 468
See application file for complete search history.

(56) References Cited

U.S. PATENT DOCUMENTS

| | | | | | |
|---|---|---|---|---|---|
| 3,237,335 | A | | 3/1966 | Kerr | |
| 3,342,134 | A | * | 9/1967 | Stadler et al. | 102/444 |
| 3,882,778 | A | * | 5/1975 | Gawlick et al. | 102/530 |
| 4,483,251 | A | | 11/1984 | Spalding | |
| 4,546,704 | A | * | 10/1985 | Ballreich et al. | 102/444 |
| 4,829,877 | A | | 5/1989 | Zerega | |
| 4,867,065 | A | | 9/1989 | Kaltman et al. | |
| 4,958,567 | A | | 9/1990 | Olson | |
| 5,180,878 | A | | 1/1993 | Denchfield | |
| 5,233,776 | A | | 8/1993 | Hessey | |
| 5,396,844 | A | | 3/1995 | Hessey | |
| 5,417,160 | A | * | 5/1995 | Mei et al. | 102/289 |
| 5,459,914 | A | * | 10/1995 | Bisping | 86/19.6 |
| 5,492,063 | A | | 2/1996 | Dittrich | |
| 6,422,149 | B1 | | 7/2002 | Saxby | |
| 6,675,717 | B2 | | 1/2004 | Jamison | |
| 7,011,028 | B1 | | 3/2006 | Emary | |
| 2001/0008107 | A1 | * | 7/2001 | Hunt | 102/444 |
| 2004/0074412 | A1 | | 4/2004 | Kightlinger | |
| 2005/0016414 | A1 | | 1/2005 | Leitner-Wise | |

OTHER PUBLICATIONS

Barnes, Frank C., Cartridges of the World—7th Edition Revised and Expanded, 1993, p. 22, 263, DBI Books, Inc., Northbrook, IL.

Cannon, Jerry L., "Firing Blanks for Handgun Training", Law Enforcement Technology Magazine, Apr. 2000, Reproduced by International Antique Reproductions, Inc., San Juan Capistrano, CA, http://www.iar-arms.com/lawenforcement.htm.

(Continued)

*Primary Examiner* — David Parsley
(74) *Attorney, Agent, or Firm* — Geoffrey M Losekamp, Esq.

(57) ABSTRACT

A blank cartridge and mated blank chamber for simulated firearms incapable of discharging projectiles. The blank cartridge has a case with a cartridge base, a case wall, a cartridge shoulder forming a neck, and a nose enclosing the blank cartridge. The blank cartridge nose provides more reliable feeding from magazines of simulated firearms. The blank cartridge dimensions render it inoperable with ammunition chambers of actual projectile-discharging firearms. The blank chamber dimensions render it inoperable with ammunition cartridges. Upon discharge the blank cartridge and chamber release exhaust gases in a forward direction, creating realistic visual and auditory effects.

20 Claims, 5 Drawing Sheets

OTHER PUBLICATIONS

Ricciardelli, Stephen, "4.6x36 mm Heckler & Koch", http://stevespages.com/jpg/cd46x33hecklerandkoch.jpg.

SAAMI, "SAAMI Cartridge and Chamber Drawings", undated, pp. 14, Sporting Arms and Ammunition Manufacturers' Institute, Newtown, CT.

SAAMI, "Unsafe Arms and Ammunition Combinations Centerfire Rifle", Technical Correspondent's Handbook, Jan. 19, 1999, Technical Data Sheets 2.0304, 2.034.2, Sporting Arms and Ammunition Manufacturers' Institute, Newtown, CT.

Sporting Arms and Ammunition Manufacturers' Institute, Inc., American National Standards Voluntary Industry Performance for Pressure and Velocity of Centerfire Rifle Sporting Ammunition for the Use of Commercial Manufacturers, Mar. 16, 1992, pp. 39-41, 69, ANSI/SAAMI Z299.4-1992, Sporting Arms and Ammunition Manufacturers' Institute, Newtown, CT.

.30-20 Hoffman [online], Jan. 22, 2003 [retrieved Sep. 6, 2007]. Retrieved from the internet: <URL:http://stevespages.com/page8d.htm.>.

* cited by examiner

CARTRIDGE AND CHAMBER FOR SIMULATED FIREARM

CROSS REFERENCE TO RELATED APPLICATIONS

This is a continuation in part of application Ser. No. 11/114,494, filed 2005 Apr. 26, now abandoned, and claims the benefit of application Ser. No. 11/114,494 and provisional patent Ser. No. 60/565,440, filed 2004 Apr. 27 by the present inventor, which are incorporated hereto by reference.

FEDERALLY SPONSORED RESEARCH

Not applicable.

SEQUENCE LISTING OR PROGRAM

Not applicable.

BACKGROUND OF THE INVENTION

1. Field of Invention

This application generally relates to a blank cartridge and chamber for use in simulated firearms not capable of discharging projectiles.

2. Prior Art

Blank cartridges are used to simulate the visual and auditory effects of ammunition cartridges. Blank cartridges include a primed case and propellant but do not have projectiles as do ammunition cartridges. The lack of a projectile permits blank cartridges to be used safely for training, theatrical, educational, and recreational purposes.

Simulated firearms are intended as safer substitutes of actual firearms for training, educational, recreational, and theatrical purposes. Simulated firearms are intended to appear like actual firearms and produce the realistic sound and visual effects of gunfire. Simulated firearms may have magazines as do actual firearms. The essential difference of simulated firearms from actual firearms is that simulated firearms cannot discharge projectiles. This characteristic makes simulated firearms safer for many uses and can exempt the devices from significant legal restrictions controlling the sale, use, and possession of actual firearms.

Blank cartridges operate similarly to firearm cartridges in general. A blank cartridge is slidably inserted into a chamber of corresponding internal dimensions. A firearm bolt is closed, seating the cartridge upon the cartridge neck, case mouth, cartridge shoulder, or case rim. A striker is forwardly released through the bolt face to impact and detonate the primer. The resulting flash is ported through one or more flash paths to the interior of the cartridge. The propellant ignites and generates highly pressurized exhaust gases. The exhaust gases are vented from the cartridge and exit through the chamber.

A cartridge, whether blank or ammunition, may be used only in a chamber of mated physical dimensions. If the cartridge does not mate within the chamber, it will not seat and be incapable of discharging. Even minor dimensional variations can prevent a cartridge from operably seating within a chamber and may cause dangerously elevated gas pressures. These dimensional constraints restrict the cartridges that may be employed in a chamber and prevent the use of unsafe cartridges.

There are two main types of blank cartridges. The first type has exterior dimensions similar to ammunition cartridges and is intended for use in actual projectile-discharging firearms.

This type of blank cartridge is thus interoperable with ammunition cartridges. An example is the 5.56×45 mm blank cartridge. This blank cartridge is interoperable with the 5.56 mm×45 mm military ammunition cartridge. The 5.56×45 mm blank cartridge vents exhaust gases in a forward direction like the related ammunition cartridge, generating realistic visual and auditory effects. This blank cartridge can cycle the action of an automatic firearm chambered for the ammunition cartridge. The disadvantage with this type of blank cartridge is that its interoperability with ammunition cartridges always risks the accidental loading and discharge of an ammunition cartridge. The inadvertent discharge of a projectile cartridge is known to cause serious damage, injury, or death.

The second type of blank cartridge is inoperable in the chamber of projectile-discharging firearms. These blank cartridges have external dimensions different from ammunition cartridges and are only operable with the mated chambers of simulated firearms. An example is the rimless 8 mm Fiocchi blank cartridge and chamber for simulated firearms. The Fiocchi blank cartridge has a flat nose which is different from the rounded bullet of a bottleneck ammunition cartridge. The Fiocchi blank cartridge and blank chamber also operate differently from ammunition cartridges and chambers. The Fiocchi cartridge is seated and detonated within the Fiocchi chamber. Instead of directing the exhaust gases in a forward direction, the Fiocchi blank cartridge ports exhaust gases laterally in a direction perpendicular to the axis of the blank cartridge. The exhaust gases are vented from the blank chamber in a similar direction lateral to the axis of the chamber. The exhaust gases are not vented through the barrel. This type of gas venting prevents a projectile from being discharged through the muzzle of the simulated firearm. However this gas venting does not create realistic visual and auditory effects. The flat nose also limits the internal capacity for propellant and restricts the volume of propellant available for visual and auditory effects. This limited propellant capacity also reduces the energy for cycling the actions of larger automatic simulated firearms. The external profile of the flat nose can cause feeding problems when employed in the magazines of automatic simulated firearms. Finally, blank cartridges adapted for this unconventional lateral porting of exhaust gases are more expensive to manufacture than other blank cartridges.

OBJECTS AND ADVANTAGES

Accordingly, there are several objects and advantage of the present invention. The blank cartridge is inoperable with projectile-discharging firearms. The unique dimensions of the blank cartridge prevent it from seating and operating within ammunition chambers of projectile-discharging firearms. The crimped cartridge shoulder forms a cartridge neck which further prevents the blank cartridge from seating within an ammunition chamber. The enclosed nose allows a greater volume of propellant to be used and also improves feeding with firearm actions and magazines. The case can be manufactured from brass stock in the common 0.223 Remington or 5.56×45 mm military chamberings, thus reducing manufacturing costs.

The unique dimensions of the blank chamber it inoperable with ammunition cartridges. The chamber shoulder also forms a chamber neck which prevents its use with ammunition cartridges, particularly variants of the 0.223 Remington or 5.56×45 mm military cartridges. When employed the blank cartridge and chamber port exhaust gases in a forward direction, producing more realistic visual and auditory effects.

Further objects and advantages will become apparent from a consideration of the ensuing description and drawings.

SUMMARY

In accordance with the invention, a blank chamber of unique dimensions, a chamber shoulder forming a chamber neck, a first body bore, a second body bore, and a third body bore which is u-shaped or partially u-shaped; and a mating blank cartridge with a base, a case wall, a cartridge shoulder forming a cartridge neck, and a nose extending from the cartridge shoulder and enclosing the cartridge.

DRAWINGS—FIGURES

An embodiment of the invention will now be described with reference to the following diagrammatic drawings in which.

DRAWINGS—REFERENCE NUMERALS

Figure 1:
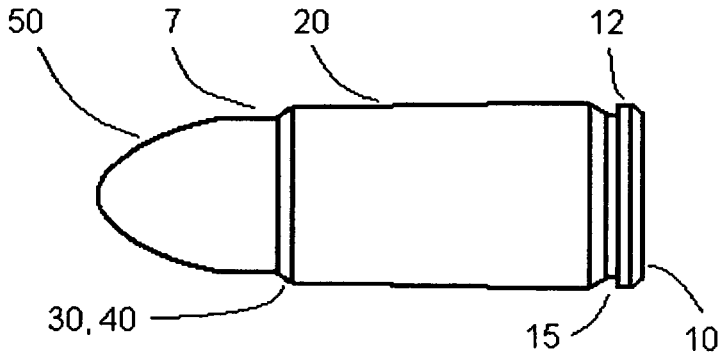
FIG. 1 shows a side view of a blank cartridge of the present invention.

7 blank cartridge
8 primer
10 cartridge base
12 rim
15 extraction groove
18 case
20 case wall
30 cartridge shoulder
40 cartridge neck
50 nose
60 propellant
70 flash path
75 case axis
80 blank chamber
90 chamber base
100 first body bore
110 first body bore cavity
120 body bore axis
140 chamber shoulder
150 chamber neck
160 second body bore
170 second body bore cavity

DETAILED DESCRIPTION—PREFERRED EMODIMENT—FIGS. 1-5

Blank Cartridge of the Present Invention—FIGS. 1-4

All dimensions described herein are tolerated within certain limits as is common to cartridges and chambers generally. The tolerated dimensional limits are essential to allow the blank cartridge to seat properly within the mated chamber. If any cartridge fails to seat properly within a chamber, the firearm may fail to fire or fire out of battery, causing possible injury or death. The tolerated dimensional limits are also necessary to maintain safe chamber pressure levels. The tolerated dimensional limits of the blank cartridge and chamber of the present invention have the following tolerances except where otherwise noted: 0.X=±0.1, 0.0X=±0.01; 0.00X=±0.005; 0.000X=±0.0005.

An embodiment of the blank cartridge of the present invention is illustrated in side view in FIG. 1. A blank cartridge 7 has a base 10, a rim 12, an extraction groove 15, and a case wall 20. The width of rim 12 is approximately 0.045 inches. The width of extraction groove 15 is approximately 0.030 inches. The case wall 20 is generally straight with a taper of approximately 1.00 degrees. Case wall 20 has a minimum width of approximately 0.0150 inches. The case wall 20 transitions into a cartridge shoulder 30. The cartridge shoulder 30 also forms a cartridge neck 40. The combined cartridge shoulder 30 and cartridge neck 40 is adjacent to nose 50. Nose 50 encloses the blank cartridge 7. The blank cartridge 7 does not have a case mouth or any projectile such as a bullet.

Figure 2:
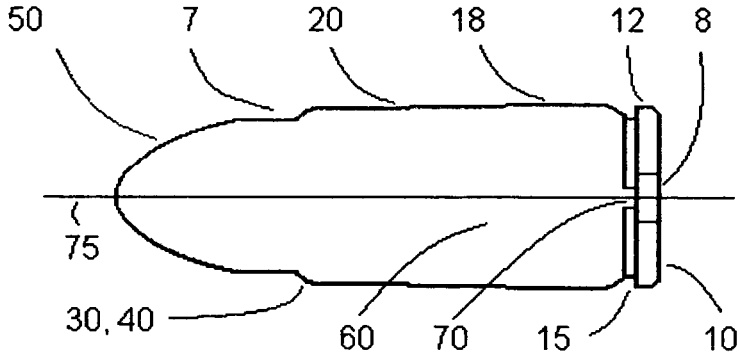
FIG. 2 shows a sectional view of a blank cartridge of the present invention.

FIG. 2 illustrates a sectional view of a primed blank cartridge 7. The blank cartridge 7 has a case 18 with case axis 75. The case 18 may be composed of a metallic or non-metallic material suitable for use with firearm cartridges generally. The combined cartridge shoulder 30 and cartridge neck 40 has a shoulder angle of approximately 30 to 45 degrees from the case axis 75. The blank cartridge 7 also has primer 8 and flash path 70. One flash path 70 is shown as used with the Boxer type of priming. The propellant 60 is contained by cavity defined by the base 10, case wall 20, and nose 50. The propellant 60 can vary by powder type and charge weight. In one preferred embodiment, the propellant 60 is between approximately 6.5 and 8.0 grains weight of Alliant Bullseye™ powder. In an alternate but equally preferred embodiment the propellant 60 is between approximately 6.8 and 8.2 grains weight of Winchester 231™ powder.

Figure 3:
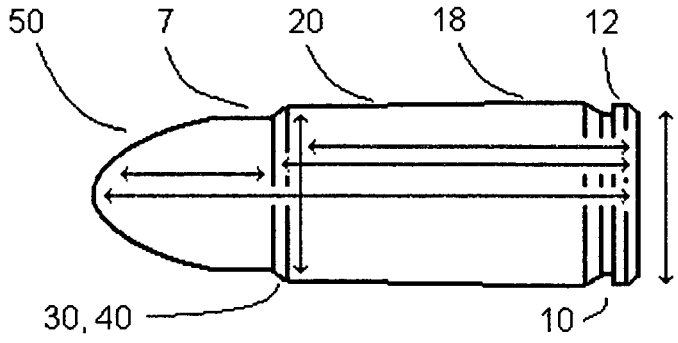
FIG. 3 shows a side view of a blank cartridge of the present invention with dimensional references indicated.

FIG. 3 shows a side view of blank cartridge 7 with external dimensional elements indicated. Case 18 has a cartridge base diameter of between approximately 0.353 to 0.381 inches. The case 18 has a total length from cartridge base 10 to nose 50 of between approximately 0.980 inches and 1.230 inches for operation with detachable magazines. The approximate length of the case wall 20 is between 0.75 inches from cartridge base 10 to the juncture of the case wall 20 and combined cartridge shoulder 30 and cartridge neck 40. The length from cartridge base 10 to the juncture of the nose 50 and combined cartridge shoulder 30 and cartridge neck 40 is approximately is 0.80 inches. The diameter of case wall 20 at the juncture with combined cartridge shoulder 30 and cartridge neck 40 is between approximately 0.342 and 0.371 inches. The external diameter of nose 50 at the juncture with combined cartridge shoulder 30 and cartridge neck 40 is not greater than approximately 0.325 inches.

Figure 4:
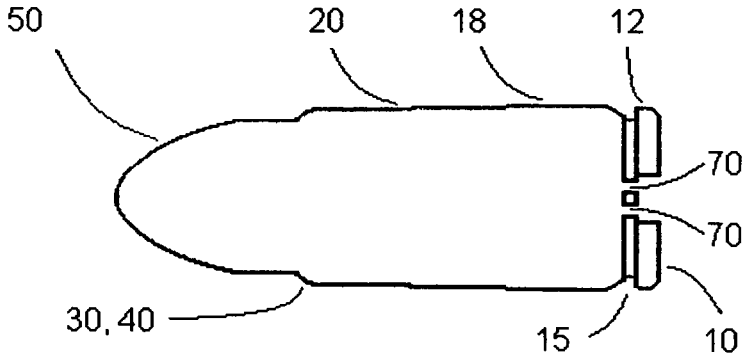
FIG. 4 shows a sectional view of a blank cartridge of the present invention with dimensional references indicated.

FIG. 4 shows a sectional view of case 18 without a primer or propellant. The case 18 shown by FIG. 4 has two flash paths 70 for use with the alternate but equivalently preferred Berdan type of priming.

Figure 5:
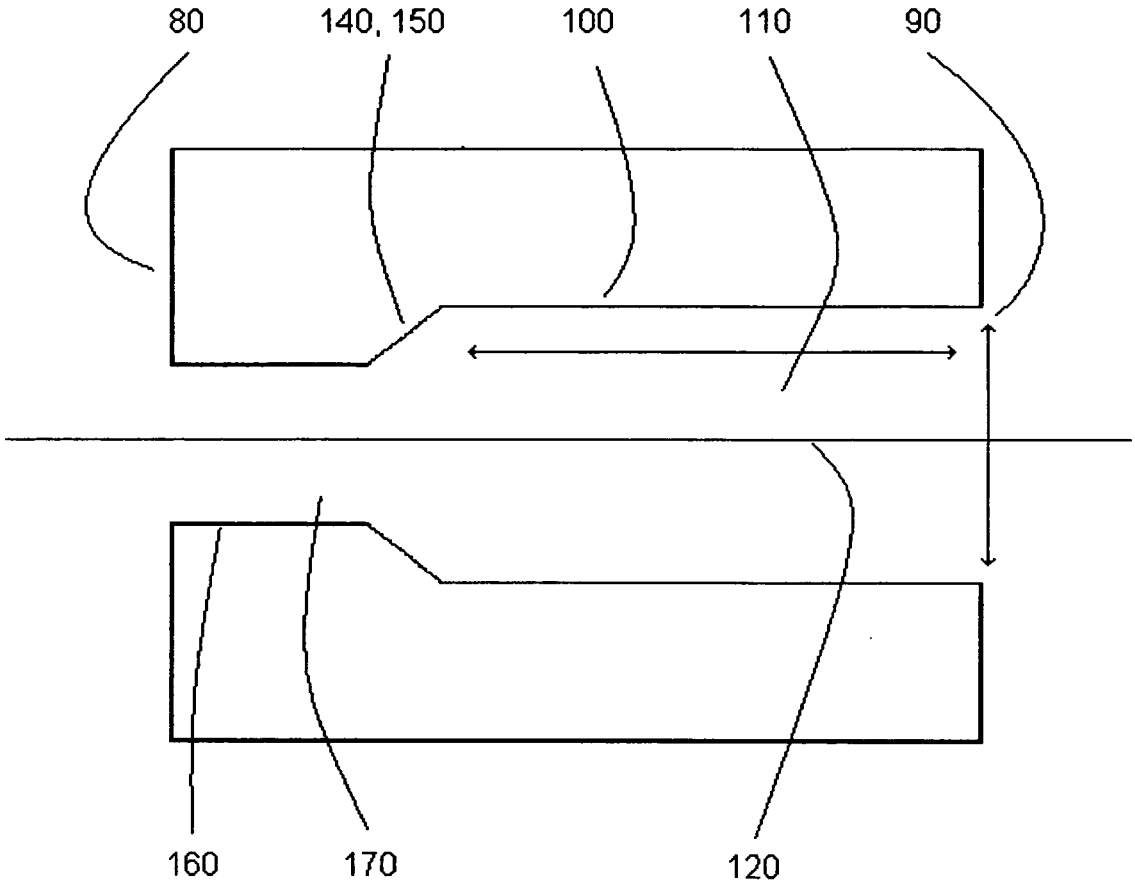
FIG. 5 shows a sectional view of a chamber of the present invention.

Blank Chamber of the Present Invention—FIG. 5

A preferred embodiment of the chamber of the present invention is illustrated in FIG. 5. FIG. 5 shows a blank chamber 80 in cross-sectional view. Blank chamber 80 has a chamber base 90, a generally cylindrical first body bore 100 defining a first body bore cavity 110, and a body bore axis 120. The diameter of chamber base 90 is approximately 0.380 inches. The first body bore 100 transitions to chamber shoulder 140. The length of the first body bore 100 is approximately 0.61 inches from the chamber base 90 to chamber shoulder 140. The chamber shoulder 140 also forms chamber neck 150. The combined chamber shoulder 140 and chamber neck 150 transitions to a second body bore 160. The second body bore 160 defines a second body bore cavity 170. The diameter of the second body bore 160 is approximately 0.33 inches at the juncture of the second body bore 160 with combined chamber shoulder 140 and chamber neck 150. The open end of second body bore 160 is in direct connection with outside of the chamber 80. Body bore axis 120 extends continuously from the chamber entrance provided by the chamber base 90 through the open end of the second body bore 160.

Operation—Preferred Embodiment—FIGS

The manner of using the blank cartridge and chamber is similar to those in current use. The blank cartridge 7 of FIG. 1 is loaded into blank chamber 80 of FIG. 5 within a simulated firearm. The combined cartridge shoulder 30 and cartridge neck 40 headspaces upon combined chamber shoulder 140 and chamber neck 150. Case wall 20 seats within first body bore 100. Nose 50 protrudes into second body bore cavity 160. Primer 8 is detonated in a conventional manner. Primer exhaust gas is ported through the flash path 70. FIG. 2 shows one flash path 70, but an equally preferred embodiment would have two flash paths 70 as shown by FIG. 4. Primer exhaust gas ignites the propellant 60. An alternative embodiment of propellant 60 could be used with a different powder and weight generating similar gas pressure to the preferred loads described above. The ignition of propellant 60 produces pressurized exhaust gas which outwardly expands nose 50. The exhaust gas vent into the second body bore cavity 170 defined by second body bore 160. Gas is ported from the open end of the second body bore 160 and escapes the blank chamber 80.

Advantages

From the description above, a number of advantages of my blank cartridge and chamber become evident:

(a) The blank chamber 80 is dimensionally inoperable with known lethal cartridges, such that lethal cartridges will not chamber or seat if inadvertently loaded. The combined chamber shoulder 140 and chamber 150 further prevent the seating of bottleneck ammunition cartridges derived from the 0.223 Remington and 5.56×45 mm military cartridges.

(b) Exhaust gases are released from the blank cartridge 7 and blank chamber 80 in a forward direction, producing more realistic visual and auditory effects than if ported laterally.

(c) The blank cartridge 7 is dimensionally inoperable with projectile-discharging firearms chambered for the 0.223 Remington or 5.56×45 mm military cartridges.

(d) The nose 50 provides the cartridge with an exterior shape similar to a lethal cartridge, permitting more reliable feeding from the magazine fed simulated firearms.

(e) The dimensions of the blank cartridge allow it to be manufactured from stock 0.223 Remington or 5.56×45 mm military brass yet also prevent the blank cartridge 7 from operating within 0.223 Remington or 5.56×45 mm military ammunition or firearm chambers.

CONCLUSION, RAMIFICATIONS, AND SCOPE

Accordingly, the reader will see that, according to the invention, I have provided a blank cartridge and chamber for safer use in simulated firearms. The blank chamber is inoperable with lethal cartridges. Similarly, the blank cartridge is inoperable with projectile-discharging firearms chambered for the 223 Remington or 5.56×45 mm military cartridges. The blank cartridge and chamber port exhaust gases in a realistic forward direction. The use of a nose provides better feeding from the magazines of simulated automatic firearms. The propellant capacity added by the nose allows greater visual and auditory effects. This increased propellant capacity can also generate more energy for cycling the actions of actions of larger simulated firearms, such as machine guns.

While the above description contains many details, these should not be construed as limitations on the scope of the invention, but as exemplifications of the presently preferred embodiments thereof. Many other ramifications and variations are possible within the teachings of the invention. For example, a second circumferential crimp around the case wall 20 could be used or omitted. The cartridge shoulder 30 and cartridge neck 40 may have a diameter smaller than 0.323 inches. The nose 50 could have a maximum diameter of less than 0.320 inches. As with conventional cartridges, the blank cartridge may be composed of a metal such as brass, steel, aluminum, or other metal. Some components such as the case 18, case wall 20, cartridge shoulder 30, or nose 50 could be alternatively be composed of a non-metallic material such as a plastic as is commonly used in modern shotgun shells. The primer 8 and flash path 70 could be adapted to Boxer or Berdan type priming by using one flash path 70 as shown by FIG. 2 or two flash paths 70 as shown by FIG. 4. The propellant 60 could vary with an alternate powder type and weight producing similar gas pressures to the loads described above. The size of primer 8 could be small rifle, large rifle, small pistol, large pistol, or shotgun. The chamber first body bore 100 could have a surface that is straight, fluted, and or lined.

Thus the scope of the invention should be determined by the appended claims and their legal equivalents, and not by the examples given.

I claim:

1. A blank cartridge, comprising a case, a cartridge base, a case wall extending from said base, with said case wall having a diameter with a reverse taper, a cartridge shoulder at the end of the case wall, said cartridge shoulder forming a cartridge neck, and a nose extending from said cartridge shoulder and said cartridge neck, and said nose enclosing said blank cartridge; and said blank cartridge having the following dimensions: base diameter of between 0.353 and 0.383 inches with a tolerance of 0.005 inches, case wall length from said base to juncture of shoulder 0.75 inches with a tolerance of 0.01 inch, external case wall diameter at juncture with said cartridge shoulder and said cartridge neck between 0.342 and 0.371 inches with a tolerance of 0.005 inches, and external diameter of said nose at the juncture with said cartridge shoulder and said cartridge neck of not greater than 0.325 inches with a tolerance of 0.005 inches.

2. A blank cartridge as defined in claim 1, wherein said blank cartridge has a total length from said cartridge base to said nose of between about 0.980 inches and 1.230 inches, with a tolerance of 0.005 inches.

3. A blank cartridge as defined in claim 2, wherein said nose of said blank cartridge has a maximum diameter of less than 0.323 inches with a tolerance of 0.005 inches.

4. A blank cartridge as defined in claim 3, wherein said nose of said blank cartridge has a maximum diameter of less than 0.320 inches with a tolerance of 0.005 inches.

5. The blank cartridge as defined in claim 2, wherein said blank cartridge has a cartridge shoulder angle of about 30 to 45 degrees.

6. The blank cartridge as defined in claim 2, wherein said blank cartridge has a primer.

7. The blank cartridge as defined in claim 2, wherein said blank cartridge has propellant.

8. A blank cartridge as defined in claim 2, wherein said blank cartridge has a metallic case.

9. A blank cartridge as defined in claim 2, wherein said blank cartridge has a non-metallic case.

10. A blank cartridge as defined in claim 2, wherein said blank cartridge has one flash path.

11. A blank cartridge as defined in claim 2, wherein said blank cartridge has two flash paths.

12. The blank cartridge as defined in claim 7, wherein said propellant is Bullseye powder.

13. The blank cartridge as defined in claim 12, wherein said propellant comprises between 6.5 and 8.0 grains weight of Bullseye powder.

14. The blank cartridge as defined in claim 7, wherein said propellant is 231 powder.

15. The blank cartridge as defined in claim 14, wherein said propellant comprises between 6.8 and 8.2 grains weight of 231 powder.

16. A case for a blank cartridge, comprising a cartridge base, a case wall extending from said base, with said case wall having a diameter with a reverse taper, a cartridge shoulder at the end of the case wall, said cartridge shoulder forming a cartridge neck, and a nose extending from said cartridge shoulder and said cartridge neck and enclosing said case; and said case having the following dimensions: base diameter of 0.378 inches with a tolerance of 0.005 inches, case wall length from said base to juncture of shoulder 0.75 inches with a tolerance of 0.01 inch, external case wall diameter at juncture with said cartridge shoulder and said cartridge neck between 0.342 and 0.371 inches with a tolerance of 0.005 inches, and external diameter of said nose at the juncture with said cartridge shoulder and said cartridge neck of not greater than 0.325 inches with a tolerance of 0.005 inches.

17. A case as defined in claim 16, wherein said case has a total length from said cartridge base to said nose of between 0.980 inches and 1.230 inches, with a tolerance of 0.005 inches.

18. A case as defined in claim 17, wherein said nose of said case has a maximum diameter of less than 0.323 inches with a tolerance of 0.005 inches.

19. A case as defined in claim 17, wherein the said nose of said case has a maximum diameter of less than 0.320 inches with a tolerance of 0.005 inches.

20. A blank chamber for a simulated firearm, comprising: a base with a base diameter of 0.38 inches with a tolerance of 0.01 inch; a first body bore extending from said base defining a generally cylindrical first body bore body cavity having a first body bore inside length of 0.61 inches with a tolerance of 0.01 inch; a chamber shoulder connected to said first body bore cavity, said chamber shoulder forming a chamber neck; a second body bore extending from said combined chamber shoulder and chamber neck defining a generally cylindrical second body bore body cavity, and a second body bore inside diameter of 0.332 inches with a tolerance of 0.005 inches at the juncture of said chamber shoulder.

* * * * *